United States Patent [19]

Stanevich et al.

[11] Patent Number: 4,957,448

[45] Date of Patent: Sep. 18, 1990

[54] LOW INSERTION FORCE, LOW BOARD STRESS ELECTRICAL CONNECTOR

[75] Inventors: Kenneth W. Stanevich, New Baltimore, Mich.; Kent E. Regnier, Lombard, Ill.

[73] Assignee: Molex Incorporated, Lisle, Ill.

[21] Appl. No.: 422,703

[22] Filed: Oct. 17, 1989

[51] Int. Cl.[5] ..... H01R 23/70

[52] U.S. Cl. ..... 439/326

[58] Field of Search ..... 439/326

[56] References Cited

U.S. PATENT DOCUMENTS

| | | | |
|---|---|---|---|
| 4,136,917 | 1/1979 | Then et al. | 439/326 |
| 4,575,172 | 3/1986 | Walse et al. | 439/326 |
| 4,737,120 | 4/1988 | Grabbe | 439/326 |
| 4,826,446 | 5/1989 | Juntwait | 439/326 |

*Primary Examiner*—Joseph H. McGlynn

*Attorney, Agent, or Firm*—Louis A. Hecht; Stephen Z. Weiss

[57] ABSTRACT

This specification discloses a low-insertion-force connector for connecting a daughter printed circuit board to a mother board. A G- or U-shaped contact is disposed in a housing so that spring arms penetrate opposing sides of the cavity. Mating ramp surfaces and latches on latch arms center the connector in the housing and urge contact pads into electrical and mechanical contact with a base circuit board. Shrouds on the housing protect various portions of the connector from harmful contact with the edge of a printed circuit board when being mounted in the housing.

10 Claims, 3 Drawing Sheets

LOW INSERTION FORCE, LOW BOARD STRESS ELECTRICAL CONNECTOR

BACKGROUND OF THE INVENTION

1. Field of the Invention

This invention relates to electrical connectors for making electrical connections to printed circuit boards. More particularly, this invention relates to zero or low insertion force electrical connectors for making electrical connections to conductive strips mounted along the edges of printed circuit boards.

2. Prior Art

There are many types of electrical connectors in the prior art for making electrical connections to conductive strips dispersed along opposing sides on the elongated edge of a printed circuit board. One such type is called a "zero insertion force" connector, which allows a circuit board to be inserted into the connector without any substantial insertion force. The board is thus inserted into the connector to make an electrical connection without any wiping and potentially harmful friction forces against the delicate electrical contacts on the opposing sides of the edge of the board.

Examples of zero insertion force connectors are disclosed in U.S. Pat. Nos. 4,575,172 and 3,848,952. These connectors generally consist of a housing enclosing a pair of generally C-shaped or U-shaped electrical contact arms of differing lengths. The edge of the printed circuit board is inserted between the arms without making contact with either arm. The board is then rotated into position in the housing so that one arm engages one side of the edge of the board and the second arm engages the opposing side of the edge of the board. At least one arm thus engages a contact on the edge of the board with sufficient normal force to assure electrical contact, but without any wiping between the arm and the contact.

One problem with certain of the older prior art connectors of the types shown in these patents is that they require interference mounting of the contacts in passages in the base of the connector. Support members for the contacts penetrate and interference fit within the connector mounting passages in the base of the connector housing to mount the contacts in the housing. When, as is common, a large number of contacts are mounted in a housing, the cumulative stress of the contact/passage interference fits can axially bow the connector housing, especially when the housing is heated during the end user application process. An axially-bowed housing is more difficult to mount on a circuit board since the center of the housing tends to bow away from the planar circuit board surface in which it is mounted. The connector may thus be mechanically as well as electrically unstable on the printed circuit board on which it is mounted.

Another problem with the prior art connectors is that of mounting the C- of U-shaped contact centered in the housing to provide the appropriate clearance between the contact arms and the housing. The C- and U-shaped contacts in the patents described above, for example, require precise location of the contacts in mounting passages in the housing in order to mount the contacts in the connector housing and attain appropriate clearance. In addition, as noted above, the contacts have support members that must fully penetrate and grip mounting passages to retain the contacts in position in the housing. These prior art contacts therefore require precise assembly techniques and relatively complicated structure to assemble and maintain the contact in the proper horizontal and vertical orientation in the housing.

Also, in many of these prior art connectors, the contacts are exposed to direct impact against the edge of a printed circuit board when the board is inserted out of alignment into the connector or when the board edge is warped to a significant degree. This direct impact can damage the contacts in the connector as well as the contacts on the edge of the board.

A still further problem with the prior art connector arises in the molding process. In order to minimize the size of a connector, the design should minimize the thickness of both the contacts and the wafer walls that maintain the spacing between the contacts. This creates a molding problem, since it is difficult if not impossible to structure a mold projection that will reliably mold a series of very thin contact spaces between very thin wafers.

SUMMARY OF THE INVENTION

It is therefore an object of this invention to provide a low-insertion-force electrical connector that will not axially bow an oversized printed circuit board when inserted into the connector.

Another object is to provide a low-insertion-force electrical connector with contact arms supported by structure that need not necessarily fully penetrate and grip a mounting passage in the housing.

Yet another object is to provide an economical low-insertion-force electrical connector that requires less complex and precise manufacturing and assembly techniques.

A further object is to provide a low-insertion-force electrical connector that protects the contact arms from potentially damaging impact of the circuit board during insertion of the board into the connector.

An additional object of the present invention is to yield a low-insertion-force electrical connector that urges contact support pads on a contact toward contact with mating board pads on a mother printed circuit board.

A still further object is to provide an economical low-insertion force connector that can be molded in such a manner that the distance between adjacent contacts is minimized and the connector is thus even further miniaturized.

There are other objects and advantages. They are apparent in the following specification.

The foregoing and other objects and advantages are achieved by our invention of a low-insertion-force electrical connector in which the housing has adjacent insulating wafers spaced apart and joined by opposing ramps. Each wafer has a board cavity for insertion of a board edge into the connector. A contact between adjacent wafers has a pair of contact arms and a pair of latch arms. The contact arms are, in one alternative, shrouded and yet accessible. Each latch arm has an inclined surface for mating contact with the ramps in the housing between the wafers. The inclined surfaces and ramps center the contact in the housing.

BRIEF DESCRIPTION OF THE DRAWINGS

The preferred embodiments of the present invention are shown in the accompanying drawing wherein.

DETAILED DESCRIPTION OF THE PREFERRED EMBODIMENT

Figure 1:
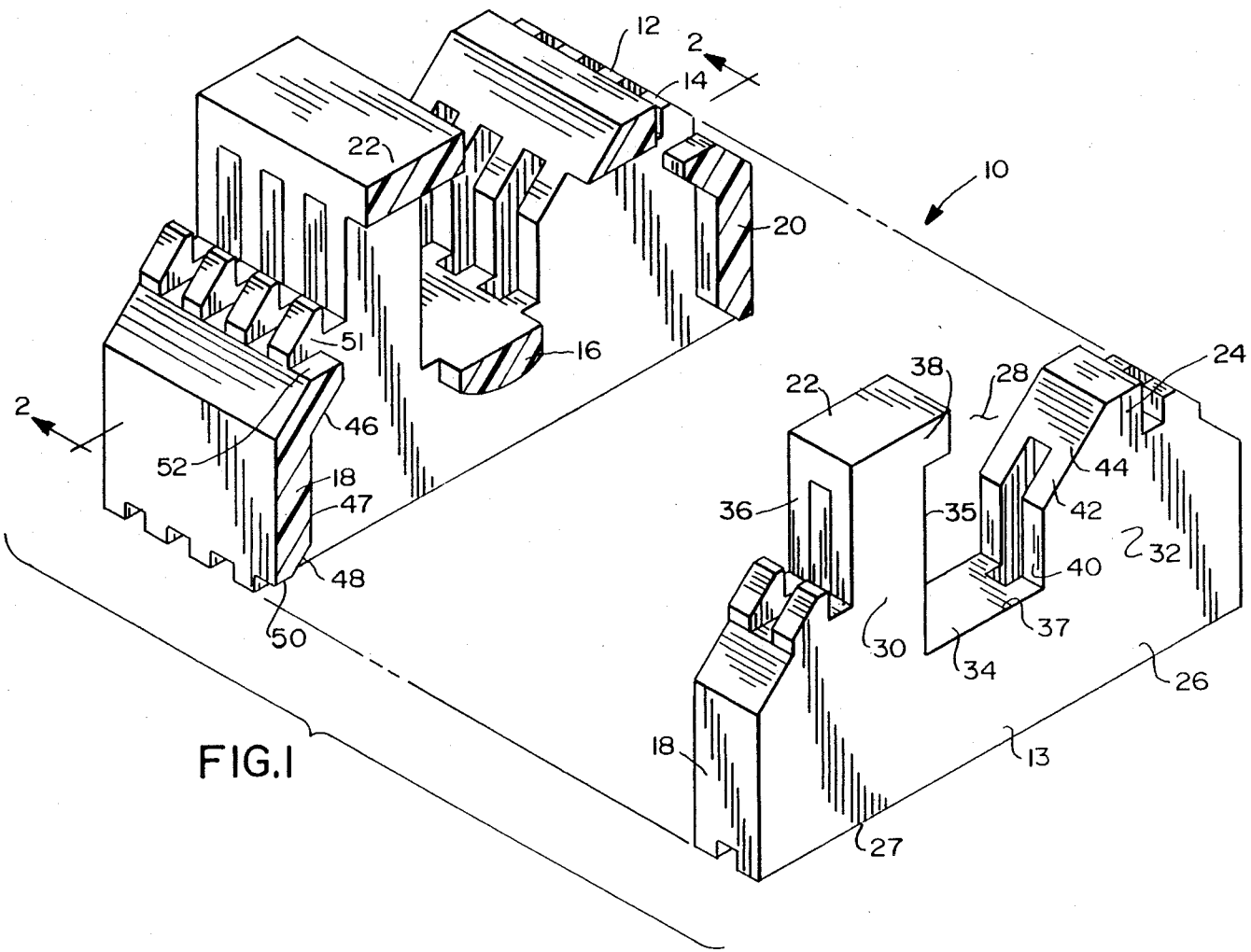
FIG. 1 is a perspective view of the electrical connector housing of the improved embodiment.
Figure 2:
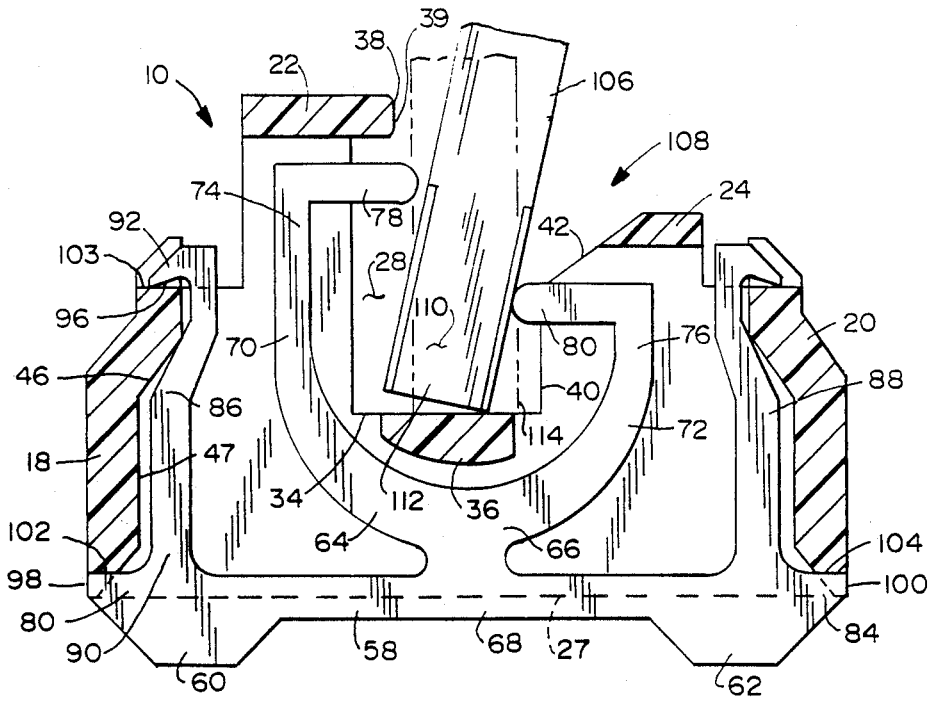
FIG. 2 is a cross-sectional view of the electrical connector housing of FIG. 1 taken along section line 2—2 of FIG. 1, depicting a shrouded G-shaped terminal connector mounted in the electrical connector housing.

FIG. 1 of the drawing shows the housing, generally 10, for an electrical connector housing having shrouded contacts such as shown in FIG. 2. The housing 10 is made of a suitable insulating thermoplastic.

The housing 10 consists of a series of interconnected, insulating, parallel, uniformly spaced wafers, 12, 14, 13. Adjacent wafers 12, 14 are interconnected by: (i) a central stop web 16, (ii) a first outer ramp 18 spaced from one side of the stop web 16, (iii) a second outer ramp 20 spaced from the other side of the stop web 16, (iv) a first shroud 22 between the first ramp 18 and the stop web 16, and (v) a second shroud 24 between the second ramp 20 and stop web 16. The stop web 16, first and second ramps 18, 20, and first and second shrouds 22, 24 extend the entire axial length A of the housing 10, providing substantial torsional stability and rigidity to the connector housing 10 with a minimum of housing material.

Each wafer, 13 for example, has a planar body 26 with a planar bottom edge 27 of the perpendicular to the plane of the wafer's body 26. A cavity 28 penetrates the central section of the body 26 on the side of the body 26 opposite the bottom edge 27 of the body 26. The cavity 28 is bounded by a first wall section 30, a second wall section 32 opposing the first wall section 30, and a flatted base section 34 interconnecting the two wall sections 30, 32.

The first wall 30 has a first planar cavity side 35 adjacent the cavity 28 and extending perpendicularly from the planar cavity bottom 37 of the flatted base section 34. The first shroud 22 extends perpendicularly from the first wall 30 toward, and to interconnect with, the adjacent wafer 36. The first shroud 22 also extends perpendicularly from the plane of the cavity side of the first wall 30 to penetrate the cavity 28.

The second wall 32 has a second planar cavity side 40 that also extends perpendicularly from the planar cavity bottom 37 of the flatted base section 34. The second wall 32 also has a third planar cavity side 42 that extends from the second cavity side 40 away from the cavity bottom 37.

The second shroud 24 extends perpendicularly from the second wall 32 toward, and to interconnect with, the adjacent wafer 36. The second shroud 24 has an inclined cavity side 44 co-planar with, and partially coextensive with, the plane of the third cavity side 42 on the second wall 32. The inclined cavity side 44 and the third cavity side 42 thus cooperatively provide an inclined ramp into a deep throat area in the cavity 28 bounded by the first cavity side 35, bottom cavity side or throat 37, and second cavity side 40.

The first ramp 18 has a first inner inclined surface 46 and a second inner inclined surface 48. The first and second inner inclined surfaces 46, 48 are parallel, but spaced apart and interconnected by a planar inner wall 47 parallel to but spaced from the first planar side 35 of the first wall section 30. The angle of incline for the inclined surface 46 is acute to the plane of the cavity's flatted base section 34, and the incline is toward the flatted base section 34 from the edges of the inclined surfaces 46, 48 furthest from the flatted base section 34.

The second inclined surface 48 is at the distal end 50 of the first ramp 18 furthest from the base section 34. The upper end 52 of the first ramp 18 is flatted and perpendicular to the planes of the wafers 12, 14, 13, 36. As measured from a line perpendicularly intersecting the upper end 52 and the plane of the distal end 50, the end 50 is spaced from the line on the side of the line opposite the flatted base section 34.

The second ramp 20 is the mirror image of the first ramp 18 on the opposite side of the flatted base section 34. Where the first and second ramps 18, 20 are coextensive with the wafers, e.g., 14, third and fourth inclined shroud sections, 54, 56 respectively, extend perpendicularly from the back end, e.g., 52, of each such ramp, e.g., 18.

Referring now to FIG. 2, the preferred embodiment of the shrouded type of contact 58 is mounted in the housing 10. The contact 58 and housing 10 cooperatively provide means for retaining the contact 58 in the housing 10 without placing any axial bowing stress on the housing 10 while simultaneously urging the lower contact pads 60, 62 on the contact 58 in a direction outwardly of and away from the bottom edge 27 of the housing 10 into contact with mating pads on a mother printed circuit board.

The contact 58 has a G-shaped board contact section 64. The mid-section 66 of the G-shaped section 64 joins a transverse support member 68. In turn, the G-shaped member has a first contact arm 70 opposite a second contact arm 72 that extends from opposing sides of the mid-section 66 distal from the transverse support member 68.

The first contact arm 70 is substantially longer than the second contact arm 72. The free ends 74, 76 of the opposing contact arms, 70, 72 respectively, extend from the mid-section 66 substantially perpendicularly from the support member 68. Each such free end 74, 76 also has a contact extension point, 78, 80 respectively, extending perpendicularly from their respective free ends 74, 76 toward each other 78, 80 in a plane parallel to the plane of the support member 68.

The contact pads 60, 62 extend somewhat from the side of the support member 68 opposite the G-shaped contact 64. The pads 60, 62 are also spaced apart, extending from the opposing ends, 82, 84 respectively, of the support member 68.

A first latch arm 86 and second latch arm 88 extend perpendicularly from the sides of the support member 68 opposite the contact pads 60, 62. The first latch arm 86 extends opposite the first contact pad 60, and the second latch arm extends opposite the second contact pad 62. The G-shaped contact section 64 is centered between, and spaced inwardly from, the substantially parallel first and second latch arms 86, 88.

The latch arms 86, 88 are mirror images of each other. The first latch arm 86, for example, has an extension end 90 extending perpendicularly from the support member 68, a latch end 92 opposite the extension end 90, and an inclined mid-ramp 94 between its two ends 90, 92. The latch end 92 extends substantially perpendicularly from the latch arm 86 away from the G-shaped contact section 64. The latch end 92 also has an undercut 96 on the outermost edge of the latch end 92 nearest the support member 68.

The inclined mid-ramp 94 is at an acute angle to the plane of the support member 68 in the direction of the G-shaped contact section 64. That angle, however, is slightly greater than that for the first inclined surface 46 of the first ramp 18 on the housing 10.

The first latch arm 86 and second latch arm 88 are spaced somewhat laterally inwardly from the outermost opposing ends 98, 100 of the support member 68. The support member 86 thus has planar latch surfaces 102, 104 that extend perpendicularly from the latch arms, 86, 88 respectively, at the outermost ends, 98, 100 respectively, of the support member 86.

The contact 64 is mounted in the housing 10 by forcing the housing 10 downwardly on the contact 64 in the orientation shown in FIG. 2. The ramps 18, 20 on the housing 10 resiliently deflect the latch arms, 86, 88 respectively, inwardly toward the G-shaped contact section 64, until the second inclined surface 48 abuts the planar latch surface 102 of the support member 68. At this point, the latch end 92 is free to resiliently retract back toward its undeflected, free-state orientation as shown in FIG. 2, because the distance between the undercut 96 and the latch surface 102 is slightly greater than the distance between the opposing mating ends 103, 105 of the first ramp 18. The first and second ramps 18, 20, are spaced apart, however, so that the first inclined surface 46 engages the mid-ramp 94 in the first latch arm 86 to urge it to deflect toward the G-shaped contact section 64. The opposite engagement of opposing surfaces at the second latch arm 86 and second ramp 20 combine to cooperatively urge the contact pads 60, 62 uniformly away form the cavity 28, and to simultaneously center the G-shaped contact 64 in the housing 10. Thus, when centered in the housing 10, the opposing contact sections 78, 80 penetrate the cavity 28. The first contact point 78 extends at a distance from the over stress lip 38 on the first shroud 22 toward the support member 68, and into the cavity 28 somewhat beyond the innermost cavity-penetrating edge 39 of the over-stress lip 38. The second contact point 80 reciprocally extends into the cavity 28 somewhat beyond the second cavity side 40 of the second wall section 32 in the vicinity of the junction of the second and third wall cavity sides 40, 42.

With continuing reference to FIG. 2, a "daughter" printed circuit board 106 is mounted in the connector, generally 108, by inserting an edge 110 of the daughter board 106 into the cavity 28 at an acute angle to flatted base section 34 without appreciable contact between the daughter board 106 and the contact arms 70, 72.

The daughter board 106 is then rotated into position perpendicular to the plane of the flatted base section 34. When in position as shown in phantom in FIG. 2, the contact extensions 78, 80 firmly engage respective sides 112, 114 of the daughter board 106 perpendicular to the planes of the sides 112, 114.

In this manner, the shrouds 22, 24, 54, 56 protect the contact 58 when the daughter board 106 is inserted in the connector 108. In addition, the first shroud 22 also serves, via its over-stress lip 38, as a board rotation stop, to prevent the daughter board 106 from deflecting the contact extensions 78, 80 any further than necessary to attain optional pressure of the extensions 78, 80 against the respective sides 112, 114 of the daughter board 106. At the same time, the flatted base section 34 and stop 36 provide a strong, rigid board stop, preventing the daughter board 106 from ramming or contacting the mid-section 66 of the contact 88.

Figure 3:
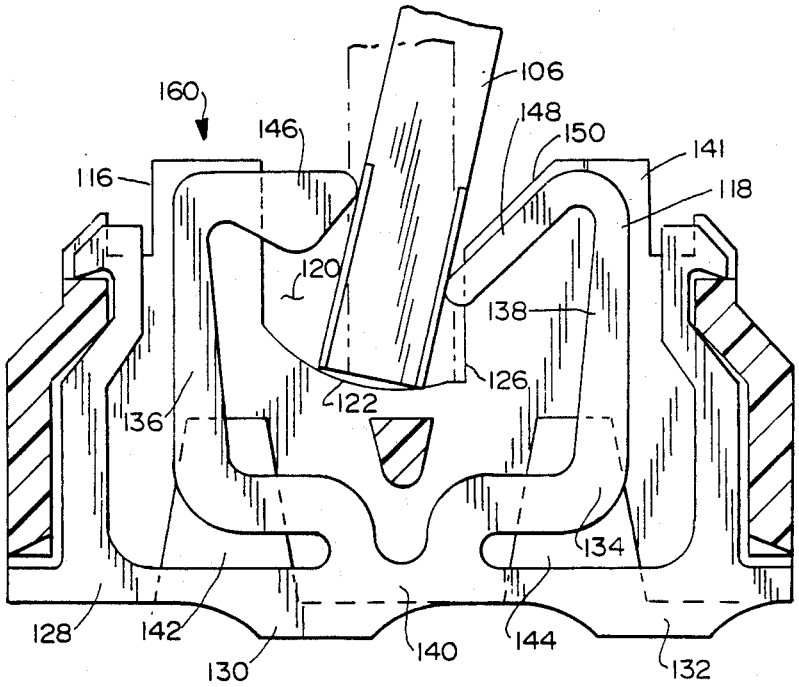
FIG. 3 is a cross-sectional view of the electrical connector having a non-shrouded U-shaped contact mounted in the electrical connector housing.

Referring now to FIG. 3, the connector housing 116 in this embodiment does not include the first and second protective shrouds 22, 24 shown in FIG. 2. In addition, the lowermost side 140 of the wafers 141 in the housing 116 each have molded recesses 142, 144 on opposite sides of the web stop 146. These recesses 142, 144 are formed by ribs in the mold (not shown) in the process of molding the housing 116. These ribs strengthen the very thin mold projection walls that form the spaces between adjacent wafers 141 in the housing 116 and wafers 141 during molding. The molded recesses 142, 144 thus reduce the extent of the thin metal projection required to mold the thin space between adjacent wafers. The wafers 141 can be molded thinner and closer together than, for example, traditional prior art, wafers not molded with such recesses 142, 144. These molded recesses 142, 144 reduce material in the housing 116 without excessively reducing its strength or torsional stability.

The contact 118 is somewhat U-shaped, and the cavity 120 has a curved throat 122 interconnecting the two opposing and parallel planar cavity sides 124, 126 extending perpendicularly to the plane of the contacts' support member 128. The pads 130, 132 on the side of the support member 128 opposite the U-shaped contact section 134 are spaced more closely together than the FIG. 2 embodiment.

Opposing contact arms 136, 138 of the contact section 134 each extend directly from the support member 128. The support member 128 thus provides a mid-section junction 146 for the two arms 136, 138.

The arms 136, 138 extend substantially the same distance as measured perpendicularly from the support member 128. At the end of the first arm 136 opposite the support member 128 is a thickened contact extension point 146 extending toward cavity 120. At the end of the second arm 138 opposite the support member 128 is an inclined contact extension 148. The inclined extension 148 penetrates the cavity 120 at an acute angle to the plane of the support member 128 from the mid-section of the cavity 120 outwardly toward the second arm 138 and away from the support member 128.

The plane of the inclined extension 148 is parallel to the plane of the inclined cavity side 150 but also spaced somewhat from the inclined side 150 in the direction of the support member 128. The inclined extension contact 148 is thus protected from damaging contact with the daughter board 106, while the thickened contact extension 146 is sufficiently strong to yield adequate normal force against the daughter board 106.

Figure 4:
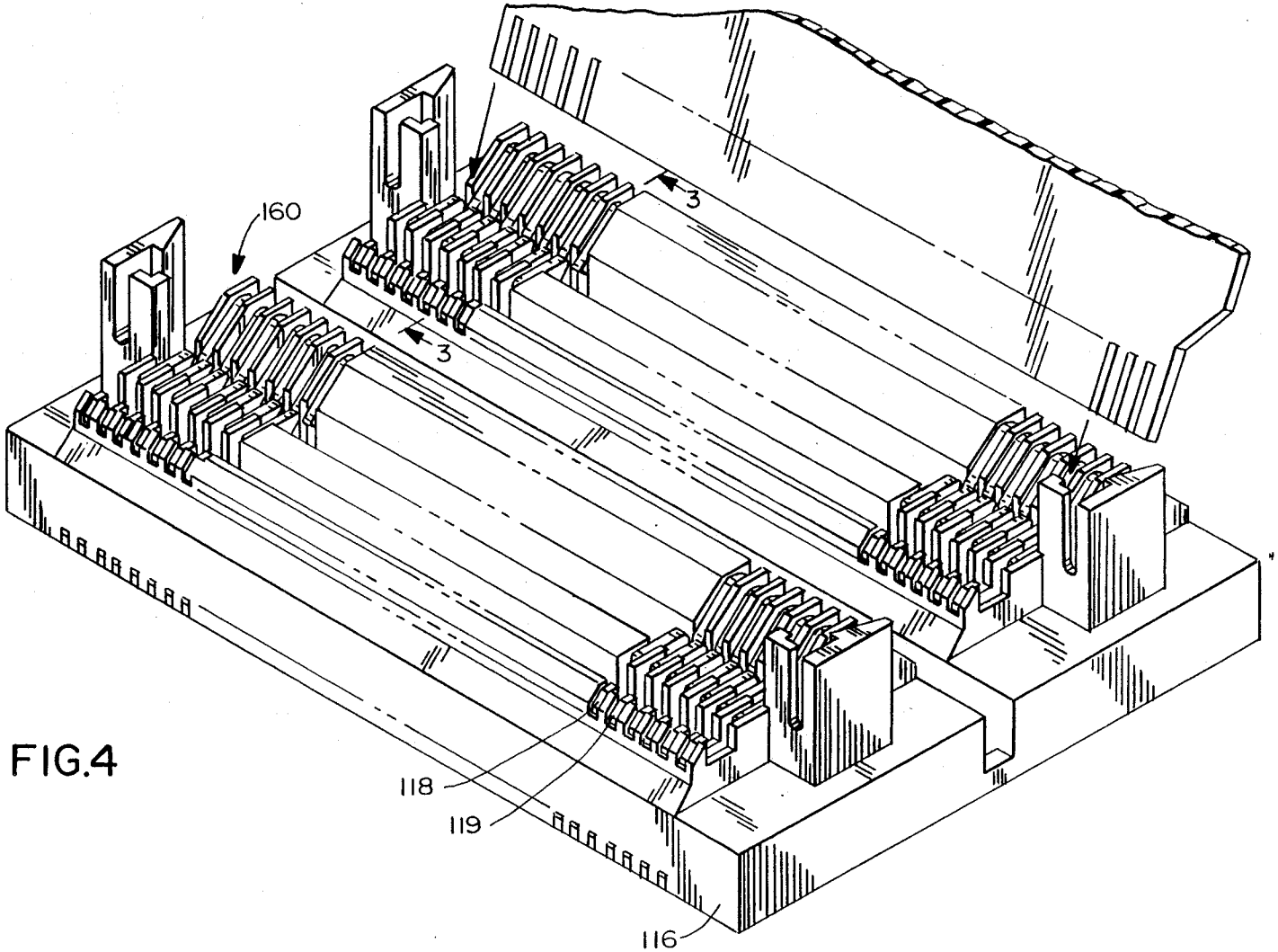
FIG. 4 is a perspective view of the invention.

The contact pads 130, 132 can be soldered to a mother printed circuit board (not shown) on which the connector, generally 160, is mounted. A series of such contacts in the spaces between adjacent wavers, such as shown in FIG. 4, provides a rigid connector 160 with virtually no axial bowing stress on the housing 116 from the contacts, e.g., 118, 119. At the same time, the contacts, e.g., 118, 119, are properly spaced horizontally and centered in the housing 116. Simultaneously, the contact pads 130, 132 (not shown in FIG. 4) are urged uniformly downwardly for proper contact with mating electrical contacts on a mother board.

It should be understood that the foregoing is a description of two preferred embodiments. The scope of the invention, however, is to be determined by reference to the following claims.

What is claimed is:

1. In a low-insertion-force electrical connector for connecting a daughter circuit board to a mother circuit board, the daughter circuit board having an edge, first and second opposed surfaces abutting the edge, and at least one contact on one of the two opposed surfaces, the electrical connector comprising in combination:

a. a housing having a plurality of adjacent insulating wafers spaced apart and joined by two opposing ramp means, each wafer having a wafer cavity, whereby adjacent wafers cooperatively provide a board cavity for penetration of the daughter board edge into the board cavity in the housing; and b. at least one contact disposed in the space between a pair of adjacent wafers, the contact having a pair of opposing contact spring means disposed in the board cavity between adjacent wafers, and a pair of cantilevered latch arms, each latch arm having an inclined latch surface for mating contact with an inclined surface of the ramp means, the inclined surfaces of the latch arms and ramp means cooperatively providing means for positioning the contact in the housing.

2. The low-insertion-force electrical connector of claim 1 wherein:

a. the housing has a daughter board mounting side opposite a mother board mounting side, with the plurality of wafers penetrating the daughter board mounting side;

b. each ramp means comprises an elongated section having opposing ramp ends and at least one inclined ramp surface between the opposing ends at an acute angle to the mother board mounting side of the housing; and c. each latch arm has opposing latch ends spaced further apart than the distance between the opposing ramp ends, the inclined latch surface being intermediate the opposing latch ends on the latch arm, and the inclined latch surfaces on the opposed latch arms being at substantially equal and opposite angles.

3. The low-insertion-force electrical connector of claim 3 wherein the contact has an inclined contact arm penetrating the cavity and each wafer adjacent the contact has a protective ramp means spaced from the inclined contact arm, whereby at least a portion of the inclined contact arm is shielded from a daughter board on insertion of the daughter board into the cavity.

4. The low-insertion-force electrical connector of claim 1 wherein the housing has at least a first shroud and a second shroud, the first shroud shielding a substantial portion of one contact arm penetrating the cavity, the second shroud shielding a substantial portion of the other contact arm penetrating the cavity, the first and second shrouds also each interconnecting adjacent wafers on the housing.

5. The low-insertion-force electrical connector of claim 4 wherein:

a. each ramp means comprises an elongated section having opposing ramp ends and at least one inclined ramp surface between the opposing ramp ends at an acute angle to the mother board mounting side of the housing; and b. each latch arm has opposing latch ends spaced further apart than the distance between the opposing ramp ends of the elongated section, the inclined latch surface being intermediate the opposing ends on the latch arm, and the inclined latch surfaces on the opposed latch arms being at substantially equal and opposite angles.

6. The improvement of claim 5 wherein the contact has an inclined contact arm penetrating the cavity and each wafer adjacent the contact has a protective ramp means spaced from the inclined contact arm, whereby at least a portion of the inclined contact arm is shielded from a daughter board on insertion of the daughter board into the cavity.

7. The low-insertion-force electrical connector of claim 1, 2, 3, 4, 5, or 6 wherein the wafers are also interconnected by a stop means adjacent a cavity throat in the cavity.

8. The low-insertion-force electrical connector of claim 7 wherein at least one wafer has at least one recess in the wafer, to minimize material in the wafer and strengthen the mold used to make the connector, without excessive loss of strength for the connector.

9. The low-insertion-force electrical connector of claim 8 wherein each latch arm has an exposed end adjacent the board cavity and each wafer also has a protective latch arm shroud adjacent the board cavity, whereby the exposed ends of the latch arms are protected from contact with the daughter board.

10. The low-insertion-force electrical connector of claim 9 wherein at least one contact has (i) a support member supporting the contact spring arms and (ii) at least one board contact pad on the side of the member opposite the contact spring means.

* * * * *